United States Patent [19]

Sullivan

[11] Patent Number: 4,881,771

[45] Date of Patent: Nov. 21, 1989

[54] CARRIER FOR PAINTINGS

[76] Inventor: Wayne R. Sullivan, 2711 Lindholm, Shreveport, La. 71108

[21] Appl. No.: 202,020

[22] Filed: Jun. 3, 1988

[51] Int. Cl.[4] ..... B65D 61/00

[52] U.S. Cl. ..... 294/151; 294/165

[58] Field of Search ..... 294/151, 137, 148, 149, 294/138, 141–143, 146, 150, 153, 154, 156, 157, 159, 162–167; 206/457, 449, 454, 455, 456; 211/41, 45

[56] References Cited

U.S. PATENT DOCUMENTS

| | | | |
|---|---|---|---|
| 188,199 | 3/1877 | Smith | 294/142 |
| 408,937 | 8/1889 | Sutton | 294/151 |
| 682,493 | 9/1901 | Pendleton | 294/138 |
| 3,295,733 | 1/1967 | Heal | 294/142 |
| 4,081,119 | 3/1978 | Messmore | 294/143 X |
| 4,156,498 | 5/1979 | Miller | 294/151 |
| 4,487,443 | 12/1984 | Adamick | 294/151 |

*Primary Examiner*—Johnny D. Cherry
*Attorney, Agent, or Firm*—John M. Harrison

[57] ABSTRACT

A carrier for transporting a framed painting or drawing, the canvas or painted surface of which has not yet dried or is easily smeared, damaged or soiled, which carrier is characterized by a box-like frame having an open front, a closed back and fitted with spacers for spacing the drawing or painted canvas surface from the closed rear panel of the frame. A flexible binder such as a string or cord is slidably threaded through spaced, parallel openings provided in the bottom panel and slotted holes located in the top panel to terminate in a handle, in order to secure the drawing or painting inside the carrier frame and transport the carrier and drawing or painting. The binder also projects around the rear panel of the carrier frame and may be looped over the top panel and around the handle into the slotted holes to facilitate carrying the frame by grasping the handle. Alternatively, the binder loop can be looped over that portion of the opposite end of the binder which extends between the slotted holes and the handle, to permit support of the frame by grasping the handle.

10 Claims, 1 Drawing Sheet

CARRIER FOR PAINTINGS

BACKGROUND OF THE INVENTION

1. Field of the Invention

This invention relates to the transportation of framed drawings or paintings and more particularly, to a carrier for transporting a drawing or painting, the canvas, painted or drawing surface of which is not yet dry or may be damaged or soiled by contact with another object. The carrier of this invention is characterized by a box-like frame having a closed back panel and open at the front, with spacers provided in the frame for insertion of a drawing or painting such that the drawing or painted surface of the drawing or painting is spaced from the back panel by the spacers. A flexible binder such as a string or cord is extended through spaced openings provided in the bottom panel and notched openings located in the top panel of the frame to mount in a handle, in order to prevent the panel from falling from the carrier frame and to facilitate convenient transportation the carrier by hand. The binder also extends around the back panel and in a loop through the notched openings provided in the top panel or around that segment of the opposite end of the binder which is attached to the handle, to facilitate hanging the carrier frame on a nail or hook for displaying or carrying the drawing or painting, as desired.

One of the problems which exists in the handling of drawings and paintings, and particularly charcoal drawings and oil paintings, where the charcoal is easily smeared and the oils used in creating the painting are slow to dry or are delicate and brittle due to age, is that of transporting the drawings and paintings from place to place without smearing, damaging or soiling the painted or charcoal surface. Various devices for carrying paintings, and oil paintings in particular, are known in the art. Typical of these devices are the large, bulky carrying devices which are commonly used to transport oil paintings but which are heavy and difficult to maneuver. Since oils used to create paintings frequency require weeks to thoroughly dry, the painted surface of the canvas cannot be allowed to touch another surface during this time period. Furthermore, the paint applied in old paintings may be brittle and cracked and therefore easily damaged by contact with another object. Moreover, the delicate hues and colors of many paintings can be easily muted or altered by soiling through contact with various objects, including dust, pollen and other airborne particles. Accordingly, under circumstances where the large and bulky conventional painting carrier devices are not practical for use, the wet or otherwise damage-vulnerable paintings and drawings must be transported by hand, with careful attention to the painted or charcoal-drawn surfaces in order to prevent smearing or other damage. This procedure is not without hazard, since merely carrying such paintings or drawings outside may result in dust, pollen and like material depositing on a wet painted or charcoal surface. Nor can the paintings or drawings be easily slipped into a sack, box or other conventional carrying device, for fear of smudging or smearing the charcoal lines or the wet oils on the painted surface or otherwise damaging the works of art.

Accordingly, it is an object of this invention to provide a carrier for transporting wet and damage-vulnerable drawings and paintings by covering the paintings and drawings in such a manner as to protect the painted or drawing surfaces from smearing, direct contact damage and from damage due to contact with dust, pollen and other airborne particles.

It is another object of this invention to provide a new and improved carrier for transporting charcoal or soft lead drawings and paintings, which carrier is characterized by a box-like frame having a closed back and an open front and fitted with a flexible binder for removably securing a painting or drawing in the frame without smearing or damaging the painted, charcoal or pencilled surface.

Another object of the invention is to provide a new and improved carrier for damage-prone drawings and paintings, which carrier includes a square or rectangular frame provided with a closed back and open at the front and further fitted with peripheral spacers and a removable, slidably-mounted string or cord binder, in order to receive a painting or drawing and space the painted or drawn surface from the back panel for transporting the painting or drawing from place to place.

Still another object of this invention is to provide a new and improved carrier for receiving and transporting paintings having a wet canvas or delicate, brittle painted surface, which carrier includes a generally rectangular or square, box-like frame having a closed back and spacers fitted around at least a portion of the inside periphery of the frame against the back panel, for receiving a painting and spacing the wet or brittle painted surface from the back panel and further including a flexible binder such as a string or cord adjustably stretched through openings in the frame and connected to a handle to retain the painting in the frame and facilitate carrying of the frame and painting.

A still further object of this invention is to provide a new and improved carrier frame for transporting charcoal and soft pencil drawings and paintings having a wet or brittle canvas, which carrier frame includes a box-like frame of selected configuration and size provided with a closed back panel and spacers provided around at least a portion of the perimeter of the frame and seated against the back panel for receiving a painting or drawing and spacing the painted or drawn surface from the back panel. Further included is a loop of flexible cord or string slidably extending through spaced openings provided in the bottom panel of the frame and stretched across the frame from bottom to top through slots provided in the top panel to a handle, with the opposite end of the loop extended over the handle for removably retaining the painting or drawing in position inside the carrier frame and gripping the handle to transport the painting.

SUMMARY OF THE INVENTION

These and other objects of the invention are provided in a new and improved carrier for drawings and paintings and particularly oil paintings, the canvas of which is either brittle and easily soiled or damaged or not yet dry, which carrier includes a box-like frame of selected size and dimensions and adapted to receive a drawing or painting of slightly smaller configuration and size, and which frame further includes a back panel and spacers located adjacent the back panel for receiving the drawing or painting, blocking the drawing or painting frame and spacing the delicate or wet canvas or drawing surface from the back panel. A flexible binder such as a string or cord which is arranged in a continuous loop, extends in sliding relationship through parallel, spaced openings located in the bottom panel of the frame and through corresponding notched openings located in the top panel of the frame and a handle is fitted to one segment of the binder for carrying purposes. The opposite segment of the binder is looped over the handle and through the notched openings to retain the drawing or painting in the frame.

BRIEF DESCRIPTION OF THE DRAWING

The invention will be better understood by reference to the accompanying drawing, wherein.

DESCRIPTION OF THE PREFERRED EMBODIMENTS

Figures 1, 2, 3, 4, 5, 6, 7, 8, 9, 10:
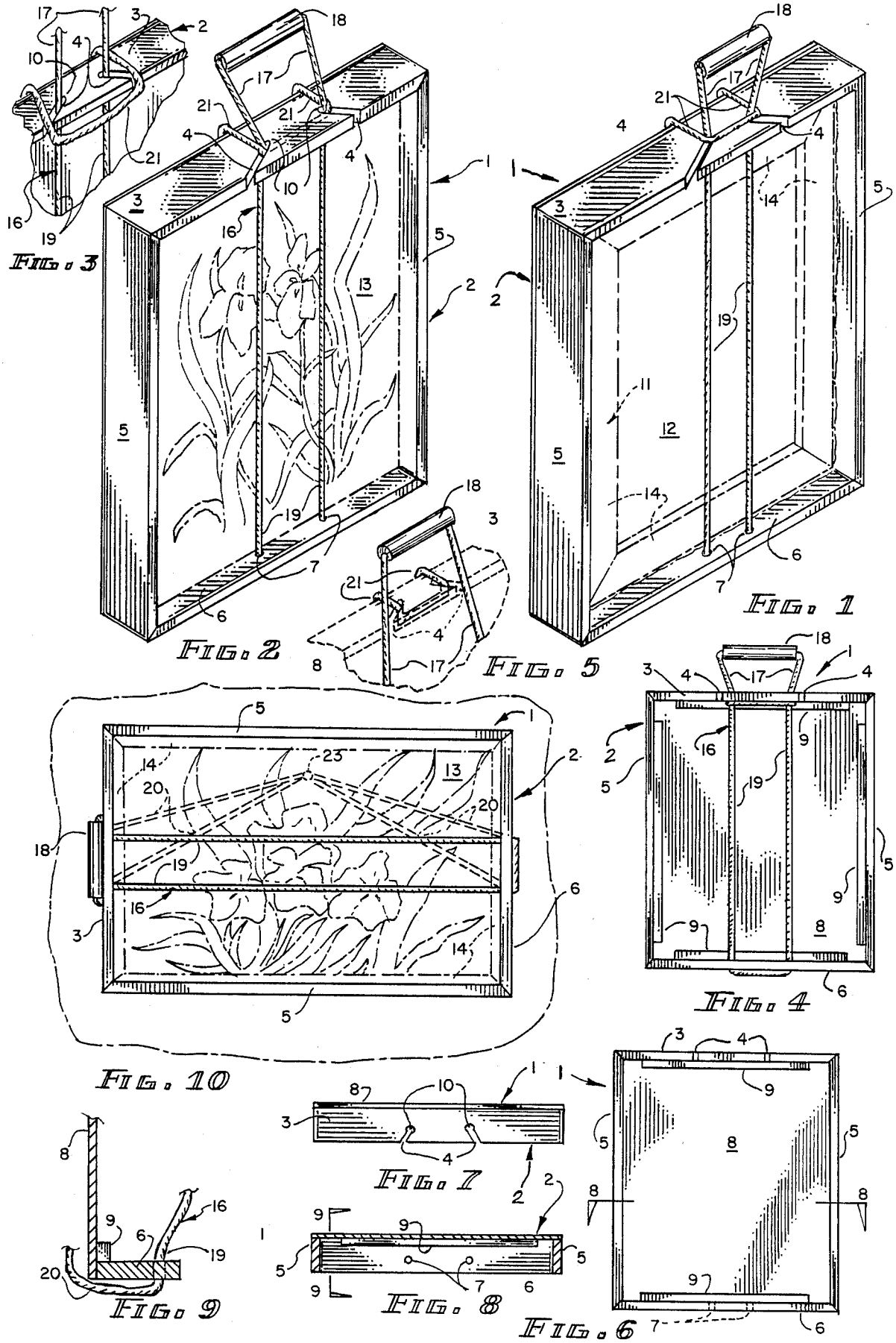
FIG. 1 is a perspective view of a preferred embodiment of the carrier for paintings of this invention, illustrating a first preferred binder configuration for carrying the painting.
FIG. 2 is a perspective view of the carrier illustrated in FIG. 1, with the painting reversed for display purposes and further illustrating a second preferred binder configuration for carrying the painting.
FIG. 3 is a perspective view, partially in section, of the top panel of the carrier, more particularly illustrating a preferred technique for effecting the carrying binder configuration illustrated in FIG. 2.
FIG. 4 is a front view of the carrier for paintings illustrated in FIG. 2, with the painting removed.
FIG. 5 is a perspective, phantom view of the carrier, more particularly illustrating tightening of the return loop of the binder in notches provided in the top panel and further securing the handle segment of the binder in the notches to effect the carrying configuration illustrated in FIG. 2.
FIG. 6 is a front view of the carrier for paintings illustrated in FIG. 4, with the binder removed.
FIG. 7 is a top view of the carrier illustrated in FIG. 6.
FIG. 8 is a sectional view taken along line 8—8 of the carrier illustrated in FIG. 6.
FIG. 9 is a sectional view taken along line 9—9 of the bottom panel of the carrier illustrated in FIG. 8.
FIG. 10 is a front elevation of the carrier mounted on a wall for displaying the enclosed painting.

Referring initially to FIGS. 1, 4 and 6–9 of the drawing, the carrier for paintings of this invention is generally illustrated by reference numeral 1 and is hereinafter designated "carrier". The carrier 1 is characterized by a generally rectangular-shaped carrier frame 2, defined by a top panel 3 having a pair of spaced top panel slots 4, each of which top panel slots 4 terminate in a slot hole 10 and a pair of parallel side panels 5 extending downwardly from the top panel 3. A bottom panel 6 spans the bottom ends of the side panels 5 parallel to the top panel 3 and a back panel 8 closes the back side of the carrier frame 2. The front side of the carrier frame 2 is open and at least one pair of spacers 9 is provided at the intersection of the top panel 3 and the bottom panel 6 with the back panel 8, respectively, as illustrated in FIG. 6. Alternatively, four such spacers 9 can be provided, with the two additional spacers 9 located at the intersection between the side panels 5 and the back panel 8, respectively, as illustrated in FIG. 4. In a most preferred embodiment of the invention, the bottom panel 6 is provided with a pair of spaced binder openings 7 near the center thereof, while the top panel 3 is fitted with corresponding top panel slots 4 located in inwardly-angled relationship and terminating at parallel slot holes 10, respectively, as illustrated in FIG. 7. As further illustrated in FIGS. 1 and 4, the ends (not illustrated) of a flexible binder 16 are threaded through the binder openings 7 located in the bottom panel 6 and an opposite loop of the binder 16 is extended around the back panel 8 and over the top panel 3 to define a return loop 21, as illustrated in FIG. 1. The parallel ends of the binder 16 are extended through the slot holes 11 and are thusly configured to define parallel retaining segments 19 which extend upwardly between the binder openings 7 and the slot holes 10 in parallel relationship and terminate in handle segments 17, which project through an opening in the handle 18 and are secured therein, to close the binder 16 in a continuous loop. Accordingly, as further illustrated in FIG. 1, in a first carrying mode, the return loop 21 is looped around the parallel handle segments 17, in order to facilitate grasping the handle 18 and hand-carrying the carrier 1 like a briefcase. It will be appreciated that the binder 16 is therefore easily slidably installed on the carrier 1 by threading each end thereof through a separate binder opening 7 and a companion aligned slot hole 10, knotting the free ends of the binder 16 together and then attaching the handle 18 to the binder 16 at the knot (not illustrated), as desired. Another technique includes extending the ends of the binder 16 through the binder openings 7 and the slot holes 10, respectively, in parallel relationship, as noted above, threading one end of the binder 16 through an opening (not illustrated) in the handle 18 and knotting the ends of the binder 16 together at a point outside of the handle 10. The knot (not illustrated) can then be forced inside the opening in the handle 18, as desired. It is understood that in a most preferred embodiment of the invention the binder 16 is slidably disposed in the binder openings 7 and slot holes 10 in a continuous loop, to facilitate enlargement of the return loop 21 for looping the return loop 21 over the handle and tightening the return loop 21 against the handle segments 17 or in the top panel slots 4. Alternatively, one end of the binder 16 can be secured to the bottom panel 6 and the opposite end fitted with a handle 18 and adapted to removably engage the top panel slot or slots 4, as desired.

Referring now to FIGS. 2–5 of the drawing, in another preferred carrying configuration the parallel retaining segments 19 of the binder 16 are extended through the slot holes 10, respectively, as illustrated and the return loop 21 is then looped over the handle 18 and the handle segment 17 and subsequently fitted in the top panel slots 4, as illustrated in FIGS. 3 and 5. The handle 18 is then grasped and tension is applied, in order to tighten the return loop 21 and secure the binder 16 into the carrying configuration illustrated in FIG. 2. Accordingly, it will be appreciated from a consideration of FIGS. 1 and 2 that a framed painting 11 can be inserted in the carrier frame 2 with the painting frame 14 seated against the spacers 9 and the canvas back 12 facing outwardly, to prevent the painted surface 13 from touching the inside surface of the back panel 8. Alternatively, the painting 11 can be inserted in reverse fashion in the carrier frame 2, with the painted surface 13 facing outwardly as illustrated in FIG. 2, for display purposes. In either or both cases, the binder 16 is disposed with the retaining segments 19 in vertical, parallel retaining configuration as illustrated, in order to retain the painting 11 inside the carrier frame 2.

Referring again to FIGS. 7 and 8 of the drawing, in a preferred embodiment of the invention the top panel slots 4 are angled inwardly at an angle of about 30 degrees with respect to the front edge of the top panel 3, in order to retain the handle segment 17 of the binder 16 securely in the slot holes 10 by tension applied to the binder 16 when the carrier frame 2 is in either of the carrying configurations illustrated in FIGS. 1 and 2. Furthermore, as illustrated in FIG. 10, it will be appreciated that the carrier 1 can be mounted on a wall with the carrier frame 2 suspended from a nail 23 or other fastener driven into the wall, by looping the return segments 20 of the binder 16 over the nail 23 and suspending the carrier frame 2 therefrom, as illustrated. Since the binder 16 is loosely threaded through the binder openings 7 and slot holes 10 in a continuous loop, the return segments 20 will assume a "V"-shaped configuration and retain the carrier frame 2 on the wall or supporting surface, as illustrated. Accordingly, the painting 11 can be oriented in the carrier frame 2 such that the painted surface 13 faces outwardly, in order to display the painting 11, as desired.

It will be appreciated by those skilled in the art that the carrier for paintings of this invention facilitates a light-weight, convenient and highly reliable means for transporting drawings and paintings of any condition and character, particularly under circumstances where the painted or drawn surface of the painting is wet, brittle, easily smeared or otherwise damaged. Accordingly, framed drawings such as charcoal and soft pencil lead renderings, as well as lead rubbing and watercolor paintings, in non-exclusive particular, can easily be transported from place to place using the carrier detailed herein. Referring again to the drawing, it will be appreciated that the carrier frame 2 can be constructed in substantially any desired configuration and size, for example, 16"×20", which are common dimensions for many paintings. Furthermore, each of the spacers 9 should be narrow, in order to insure that the spacers 9 will contact only the painting frame 14 and will not touch the painted surface 13 and thereby smear the wet paint or otherwise damage the painted surface 13. Moreover, it is understood that the carrier frame 2 may be constructed of substantially any desired material, including wood, plastic and metal such as aluminum, as well as fiberglass or other material. However, in a preferred embodiment of the invention, the carrier frame 2 may be injection-molded from a suitable plastic material according to the knowledge of those skilled in the art. Under circumstances where the carrier frame 2 is constructed of wood, the back panel 8 is typically shaped from 3/16" plywood, the handle may be constructed from a ½ inch dowel which has a longitudinal hole drilled therein to receive the handle segment 17 of the binder 16 and the binder 16 is string or cord having a diameter of about ⅛ of an inch. Under circumstances where the carrier frame 2 is 16 inches wide and 20 inches high, the binder may be from 105 inches to about 110 inches in length. Furthermore, the top panel 3, side panels 5 and bottom panel 6 of the carrying frame 2 may be constructed of any type of wood and the spacers 9 may be glued, stapled, nailed or otherwise attached to the back panel 8 and/or to the top panel 3, side panels 5 and bottom panel 6, according to the knowledge of those skilled in the art.

It will be further understood that the painting frame 14 which is illustrated in the drawing is designed to temporarily receive a canvas or other painting surface, in order to create the painted surface 13. The painting frame 14 also serves to seat the painting 11 in the carrier 1, as heretofore described. After the paint dries, a suitable display frame (not illustrated) which is designed to display the painting on a permanent basis may be used to mount the painting or drawing. However, a painting or drawing which is permanently mounted in such a display frame may also be easily and safely transported in the carrier 1, according to the teaching of this invention.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A carrier for a work of art comprising a frame having a closed back panel and an open front area for receiving the work of art; at least two spacers attached to said frame in spaced relationship for spacing the work of art from said back panel; a pair of spaced cord openings provided in one end of said frame and a pair of slotted holes provided in the opposite end of said frame; a continuous flexible cord having a first loop extended through said space cord openings and said slotted holes in spaced relationship; a handle attached to said cord; and a second loop extended around said back panel and looped over said handle and said first loop, for removably securing the work of art in said frame.

2. A carrier for transporting and displaying a painting or drawing comprising a frame characterized by a top panel, a bottom panel, a pair of side panels spacing said top panel and said bottom panel and a rear panel carried by said top panel, said bottom panel and said side panels, said rear panel closing the rear of said frame and said frame being open at the front for removably receiving the painting or drawing; at least one pair of spacers mounted in said frame in spaced relationship for spacing said painting or drawing from said rear panel; and a flexible binder adapted for extension from said bottom panel to said top panel and projecting across said open front for preventing the painting or drawing from exiting said frame.

3. The carrier of claim 2 wherein said at least one pair of spacers further comprises two pairs of spacers attached to said frame in spaced, oppositely-disposed relationship, respectively.

4. The carrier of claim 2 further comprising a handle attached to said flexible binder for transporting said carrier.

5. The carrier of claim 2 wherein said at least one pair of spacers further comprises two pairs of spacers attached to said frame in spaced, oppositely-disposed relationship and further comprising a handle attached to said flexible binder for transporting said carrier.

6. The carrier of claim 2 further comprising at least one binder opening provided in said bottom panel of said frame and at least one slotted hole provided in said top panel of said frame and wherein one end of said flexible binder is slidably extended through said binder opening and said slotted hole and the opposite end of said flexible binder is extended around said back panel and said opposite end of said flexible binder is looped over said one end of said flexible binder for grasping said one end of said flexible binder and transporting said carrier.

7. The carrier of claim 6 further comprising a handle attached to said flexible binder for transporting said carrier.

8. The carrier of claim 7 wherein said at least one binder opening further comprises a pair of spaced binder openings, said at least one slotted hole further comprises a pair of slotted holes disposed substantially opposite and in alignment with said binder openings, respectively, and said flexible binder further comprises a continuous flexible binder having a first loop extended through said spaced binder openings and said slotted holes to said handle in spaced, substantially parallel relationship and further comprising a second loop extended around said back panel and looped over said handle and said first loop, for removably securing the painting in said frame.

9. The carrier of claim 8 wherein:

(a) said at least one pair of spacers further comprises two pairs of spacers attached to said frame in spaced, oppositely-disposed relationship, respectively; and (b) said flexible binder is a length of cord having a selected diameter which is smaller than the diameter of said binder openings and said slotted holes.

10. A carrier for transporting a painting comprising a frame characterized by a top panel, a bottom panel, a pair of side panels spacing said top panel and said bottom panel and a rear panel carried by said top panel, said bottom panel and said side panels, said rear panel closing the rear of said frame and said frame being open at the front for removably receiving the painting; at least one pair of spacers mounted in said frame in spaced relationship for spacing said painting from said rear panel; a flexible binder arranged in a continuous loop having a top loop portion adapted for slidable extension from said bottom panel to said top panel and projecting across said open front for removably securing the painting in said frame, with a handle secured to said top loop portion, and a bottom loop portion extending from said top loop portion around said bottom panel, said rear panel and said top panel, said bottom loop portion looped over said handle and said top loop portion for transporting said carrier.

* * * * *